US010602831B2

(12) United States Patent
Rowe

(10) Patent No.: US 10,602,831 B2
(45) Date of Patent: Mar. 31, 2020

(54) BACKPACK WITH HINGED BACK PANEL

(71) Applicant: ACCO Brands Corporation, Lake Zurich, IL (US)

(72) Inventor: Michael D. Rowe, Medway, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 15/210,522

(22) Filed: Jul. 14, 2016

(65) Prior Publication Data

US 2017/0013947 A1 Jan. 19, 2017

Related U.S. Application Data

(60) Provisional application No. 62/193,972, filed on Jul. 17, 2015.

(51) Int. Cl.
*A45F 3/04* (2006.01)
*A45C 13/10* (2006.01)

(52) U.S. Cl.
CPC ..... *A45F 3/04* (2013.01); *A45C 13/103* (2013.01)

(58) Field of Classification Search
CPC ..... A45F 3/04; A45C 13/103
USPC ..... 224/645
See application file for complete search history.

(56) References Cited

U.S. PATENT DOCUMENTS 5,004,134 A * 4/1991 Barry ..... A45C 3/10 224/235
5,407,112 A * 4/1995 Christodoulou ..... A41D 15/04 2/94
5,431,265 A * 7/1995 Yoo ..... A45C 3/00 190/103
5,611,457 A * 3/1997 Ash, Jr. ..... A45F 3/04 221/185

(Continued)

FOREIGN PATENT DOCUMENTS

| | | |
|---|---|---|
| CN | 202104446 | 1/2012 |
| DE | 202004015475 | 10/2005 |
| WO | 2006/089462 | 8/2006 |

OTHER PUBLICATIONS

PCT, International Search Report and Written Opinion, International Application No. PCT/US2016/042237 (dated Oct. 26, 2016).

*Primary Examiner* — Derek J Battisti
(74) *Attorney, Agent, or Firm* — Fitch, Even, Tabin & Flannery LLP

(57) ABSTRACT

A backpack including a body having a back surface configured to be positioned adjacent to a back of a wearer when the backpack is worn. The body further includes a front surface at least partially spaced away from the back surface to at least partially define an inner cavity therebetween. The backpack has a storage component positioned within the inner cavity and at least one shoulder strap coupled to the body and positionable over a shoulder of a wearer. The backpack further has a releasable fastener that is movable to an open position to provide access to the inner cavity and (Continued)

movable to a closed position to block access to the inner cavity. The back surface includes a hinge about which the back surface is predisposed to bend, and the backpack is configured such that when the releasable fastener is in the open position at least part of the back surface is pivotable about the hinge to provide access to the inner cavity. The hinge is positioned below the storage component.

17 Claims, 7 Drawing Sheets

(56) References Cited

U.S. PATENT DOCUMENTS 5,749,503 A * 5/1998 Wulf ..... A45C 5/14 190/18 A
5,927,581 A 7/1999 Reddy et al.
5,984,154 A * 11/1999 Scicluna ..... A45C 5/14 190/18 A
6,053,382 A 4/2000 Wyant
6,592,012 B2 7/2003 Godshaw et al.
7,832,532 B2 * 11/2010 Nykoluk ..... A45C 13/262 16/113.1
7,886,884 B2 2/2011 King et al.
9,027,813 B2 * 5/2015 Murdoch ..... A45F 3/04 224/637
9,642,443 B2 * 5/2017 Amago ..... A45F 3/04
2009/0127046 A1 * 5/2009 King ..... A45C 9/00 190/18 A
2010/0108731 A1 * 5/2010 Rowe ..... A45F 3/042 224/654
2011/0127304 A1 * 6/2011 Kam ..... A45F 3/04 224/153
2013/0043293 A1 * 2/2013 Connell ..... A45F 3/04 224/652
2013/0327803 A1 * 12/2013 Chiang ..... A45F 3/04 224/582
2015/0129629 A1 * 5/2015 Voggenthaler ..... A45F 3/04 224/645
2015/0374105 A1 * 12/2015 Rowe ..... A45F 3/04 224/645

* cited by examiner

BACKPACK WITH HINGED BACK PANEL

This application claims priority to U.S. Provisional Patent Application Ser. No. 62/193,972, filed on Jul. 17, 2015 and entitled BACKPACK WITH HINGED BACK PANEL, the entire contents of which are hereby incorporated by reference.

BACKGROUND

Backpacks are widely used by students and other users to store books, school supplies, office supplies, travel supplies, and the like in an inner cavity of the backpack. However, in many existing backpacks it may be difficult to access the inner cavity. In particular, many backpacks utilize a fastener extending across an outer surface of the backpack that can be opened to provide access to the inner cavity. However, when the fastener is open the corresponding opening may provide only limited access to the inner cavity, thereby impeding the insertion or removal of relatively large or bulky items and/or viewing the contents of the inner cavity.

SUMMARY

In one embodiment, the present invention is a backpack with a hinged panel to provide improved access to the backpack. More particularly, in one embodiment the invention is a backpack including a body having a back surface configured to be positioned adjacent to a back of a wearer when the backpack is worn. The body further includes a front surface at least partially spaced away from the back surface to at least partially define an inner cavity therebetween. The backpack has a storage component positioned within the inner cavity and at least one shoulder strap coupled to the body and positionable over a shoulder of a wearer. The backpack further has a releasable fastener that is movable to an open position to provide access to the inner cavity and movable to a closed position to block access to the inner cavity. The back surface includes a hinge about which the back surface is predisposed to bend, and the backpack is configured such that when the releasable fastener is in the open position at least part of the back surface is pivotable about the hinge to provide access to the inner cavity. The hinge is positioned below the storage component.

DETAILED DESCRIPTION

Figure 4:
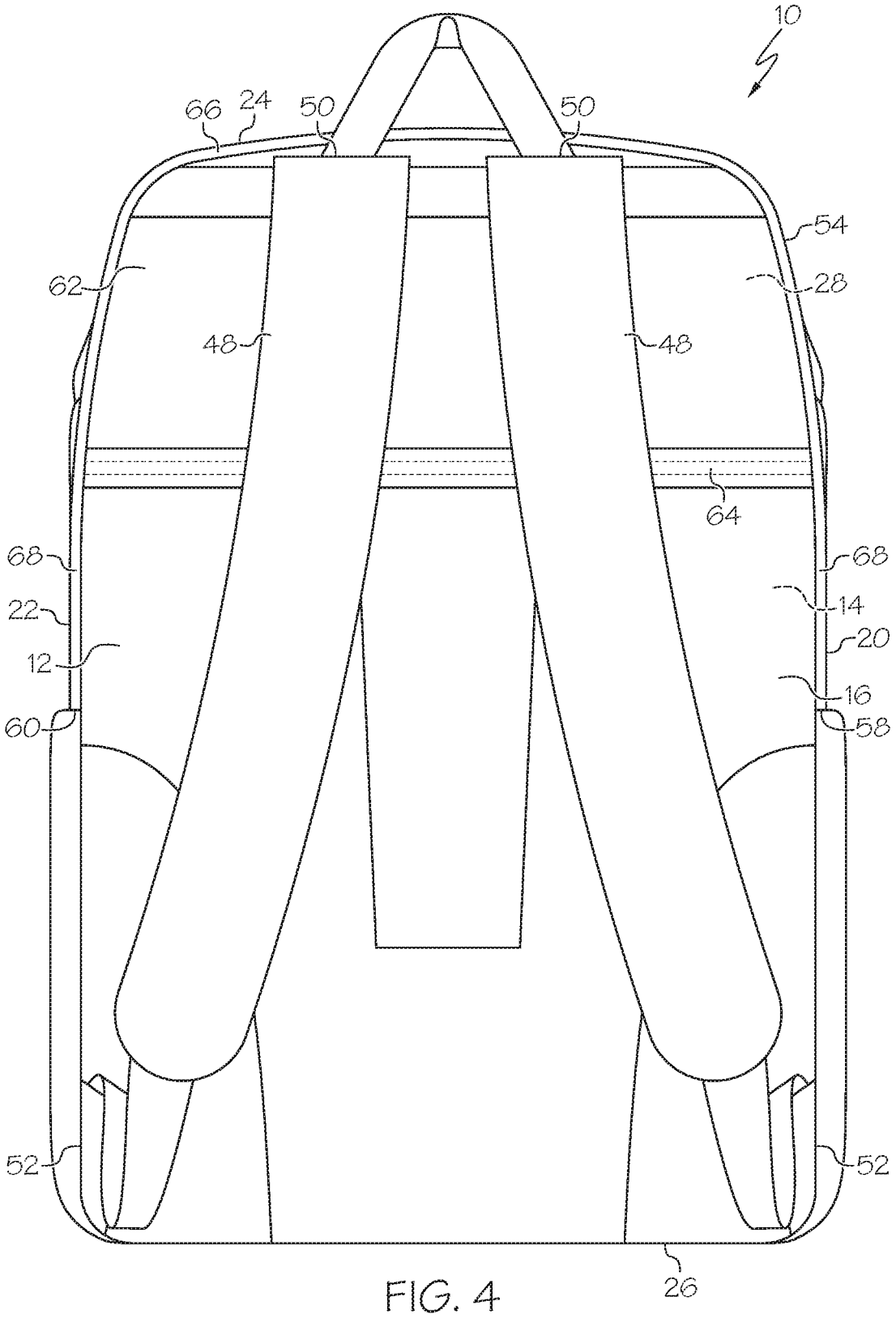
FIG. 4 is a rear view of the backpack of FIG. 1.
Figure 5:
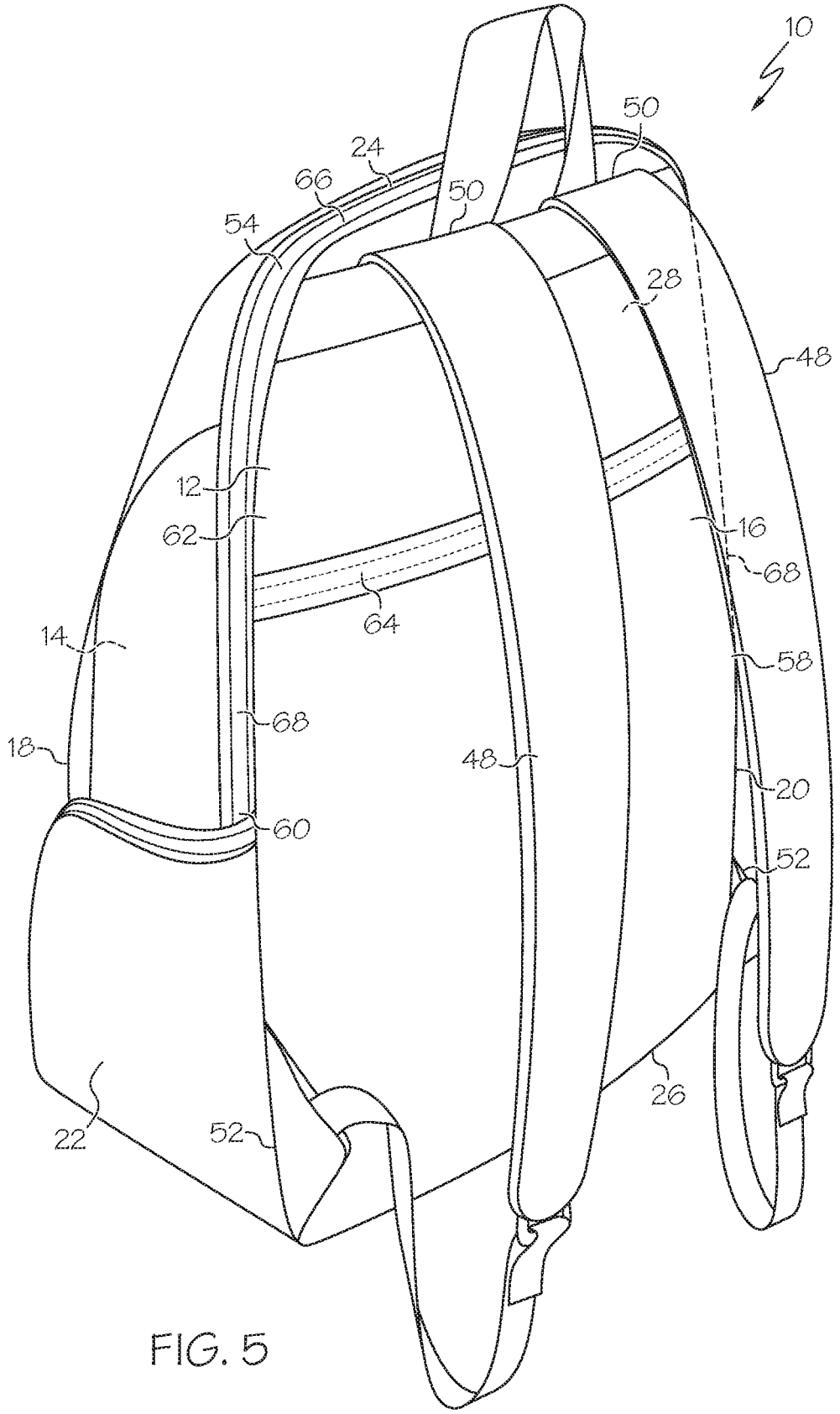
FIG. 5 is a rear perspective view of the backpack of FIG. 1.
Figure 6:
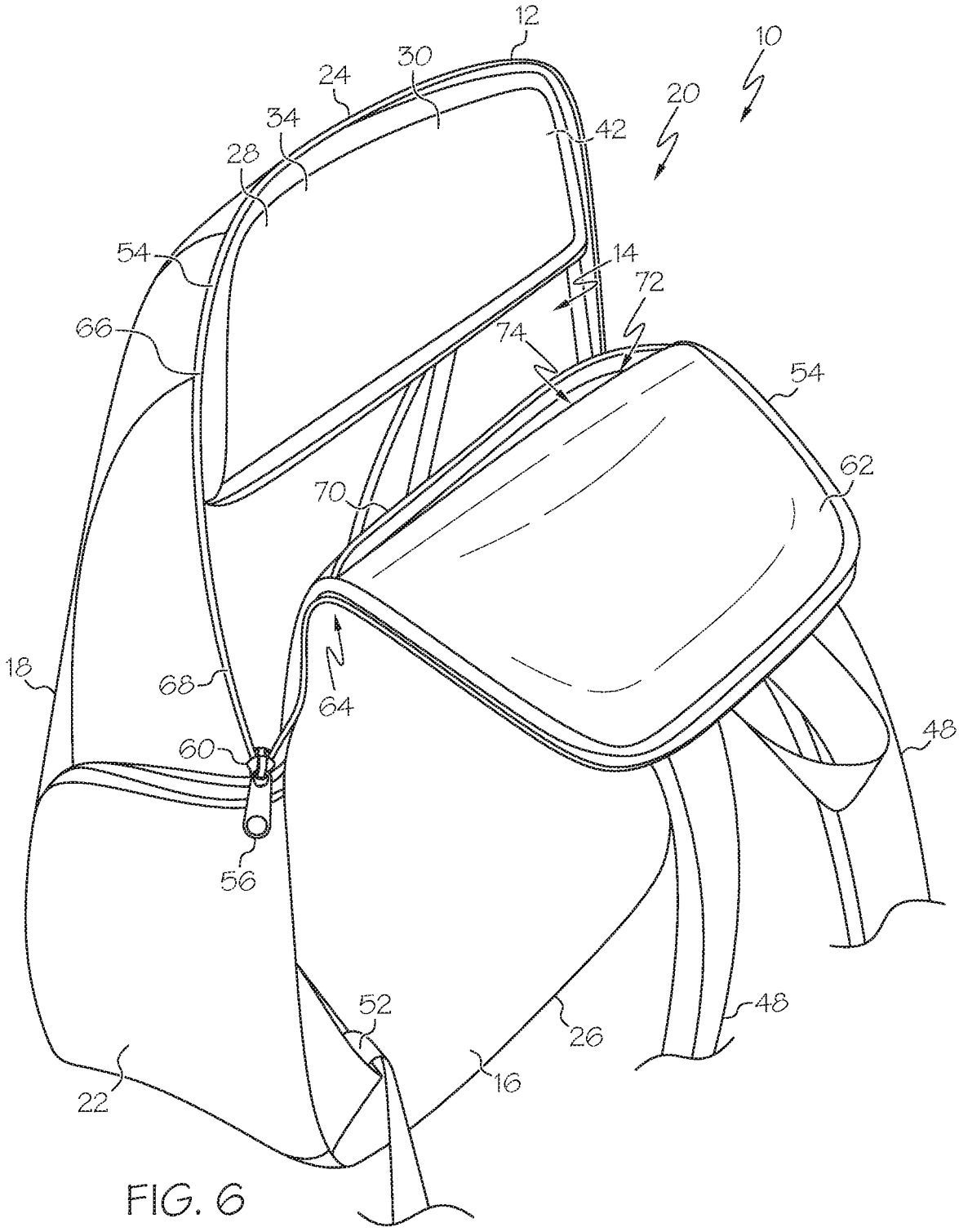
FIG. 6 illustrates the backpack of FIG. 5, with the fastener opened and the back surface folded down.
Figure 7:
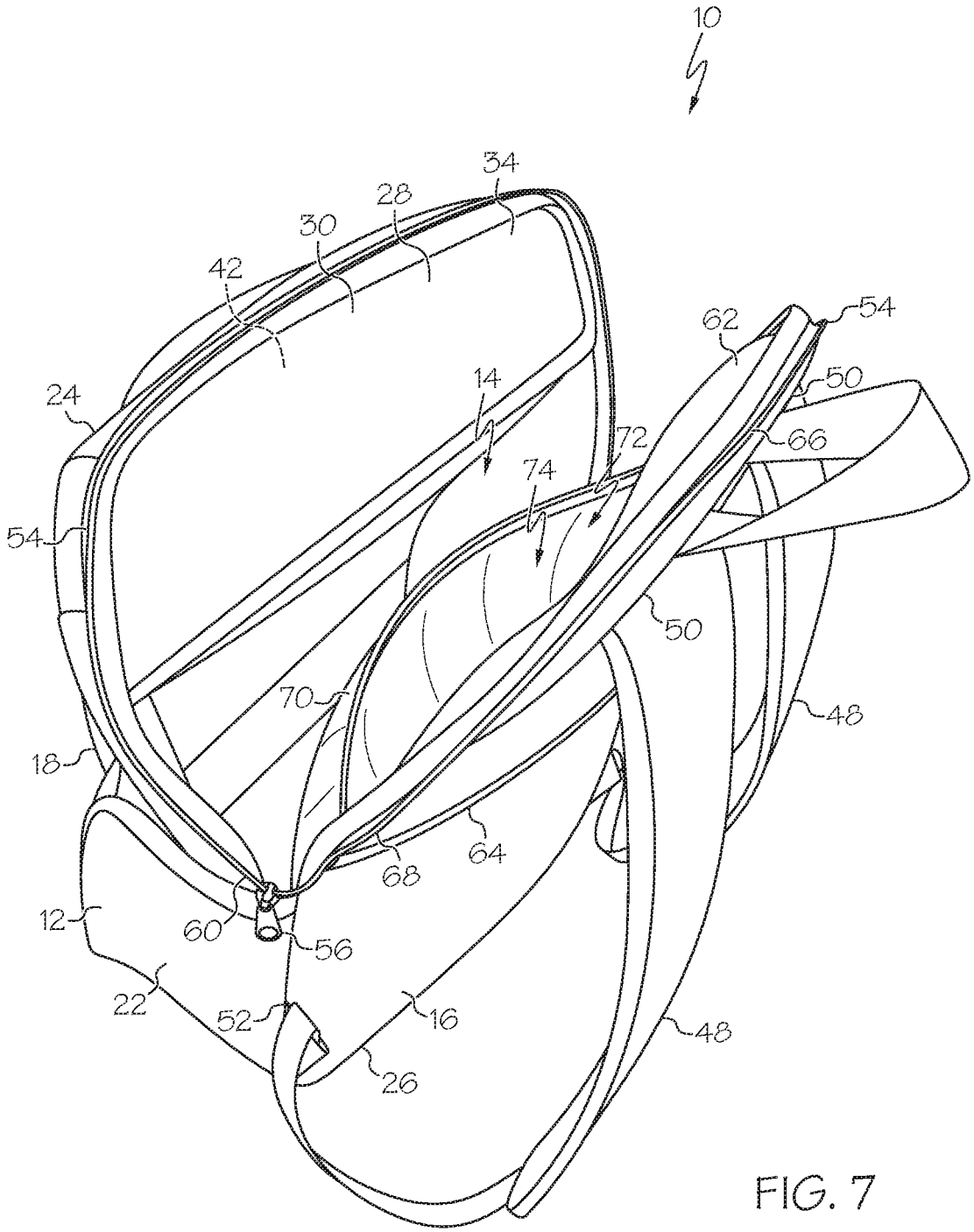
FIG. 7 is a rear upper perspective view of the backpack of FIG. 1, with the fastener opened.

With reference to FIGS. 1-7, in one embodiment the backpack 10 of the present invention can include a body 12 with an inner cavity or storage compartment 14 therein (see FIGS. 6 and 7). In one case the inner cavity 14 defines a majority or an entirety of an inner volume of the body 12. The body 12 can include a back surface 16 configured to be positioned adjacent to the back of a wearer when the backpack 10 is worn. In the illustrated embodiment, the back surface 16 is generally flat and planar, and generally rectangular. In some cases the back surface 16 can be relatively stiff such that the back surface 16 remains generally flat and planar when the backpack 10 rests on a ground surface and the back surface 16 is arranged vertically with respect to a gravitational frame of reference, such that the back surface 16 lends support to the entire body 12 and enables the body 12 to maintain its configuration shown in FIGS. 1, 2 and 4-7 without any external support. However, the back surface 16 need not necessarily have stiffness to this degree, and also can take other shapes and configurations if desired.

The body 12 can further include a front surface 18 that is at least partially spaced away from the back surface 16 to at least partially define the inner cavity 14 therebetween. In some cases, the front surface 18 is generally parallel to and spaced apart from the back surface 16. The body 12 can further include a pair of opposed side surfaces 20, 22, where each side surface 20, 22 extends between the back surface 16 and the front surface 18. The side surfaces 20, 22 can be oriented generally parallel to each other and oriented generally perpendicular to the back surface 16 and/or front surface 18. The body 12 can also include an upper surface 24 and a lower surface 26, wherein the upper 24 and lower 26 surfaces can be oriented generally parallel to each other (in one case) and positioned on opposite side of the body 12/inner cavity 14. The upper 24 and lower 26 surfaces can each extend between the back surface 16 and front surface 18, and also extend between the side surfaces 20, 22. The inner cavity 14 can thus be positioned between the back surface 16, front surface 18, side surfaces 20, 22, upper surface 24 and lower surface 26. In the illustrated embodiment the upper surface 24 generally extends at an angle or along a curved path between the front surface 18 and back surface 16.

It should be understood that the back surface 16, front surface 18, side surfaces 20, 22, upper surface 24 and lower surface 26, although separated in some cases by a curved transition as shown in the embodiment of FIGS. 1-7, may nevertheless be relatively easy to discern such that the body 12 generally takes the form of a six-sided rectangular prism. In other cases, however, the surfaces, particularly the front surface 18, side surfaces 20, 22, upper surface 24 and/or lower surface 26 may not be strictly parallel/perpendicular, and can also have smoothly continuous transitions therebetween or be formed of a single curved shape, or be defined by a relatively flexible material, such that there is no sharp delineation between the surfaces. Nevertheless, in such cases the surfaces may be able to be defined or assigned based upon relative positioning relative to the back surface 16, even if such surfaces are not generally flat, planar, or clearly defined.

Figure 1:
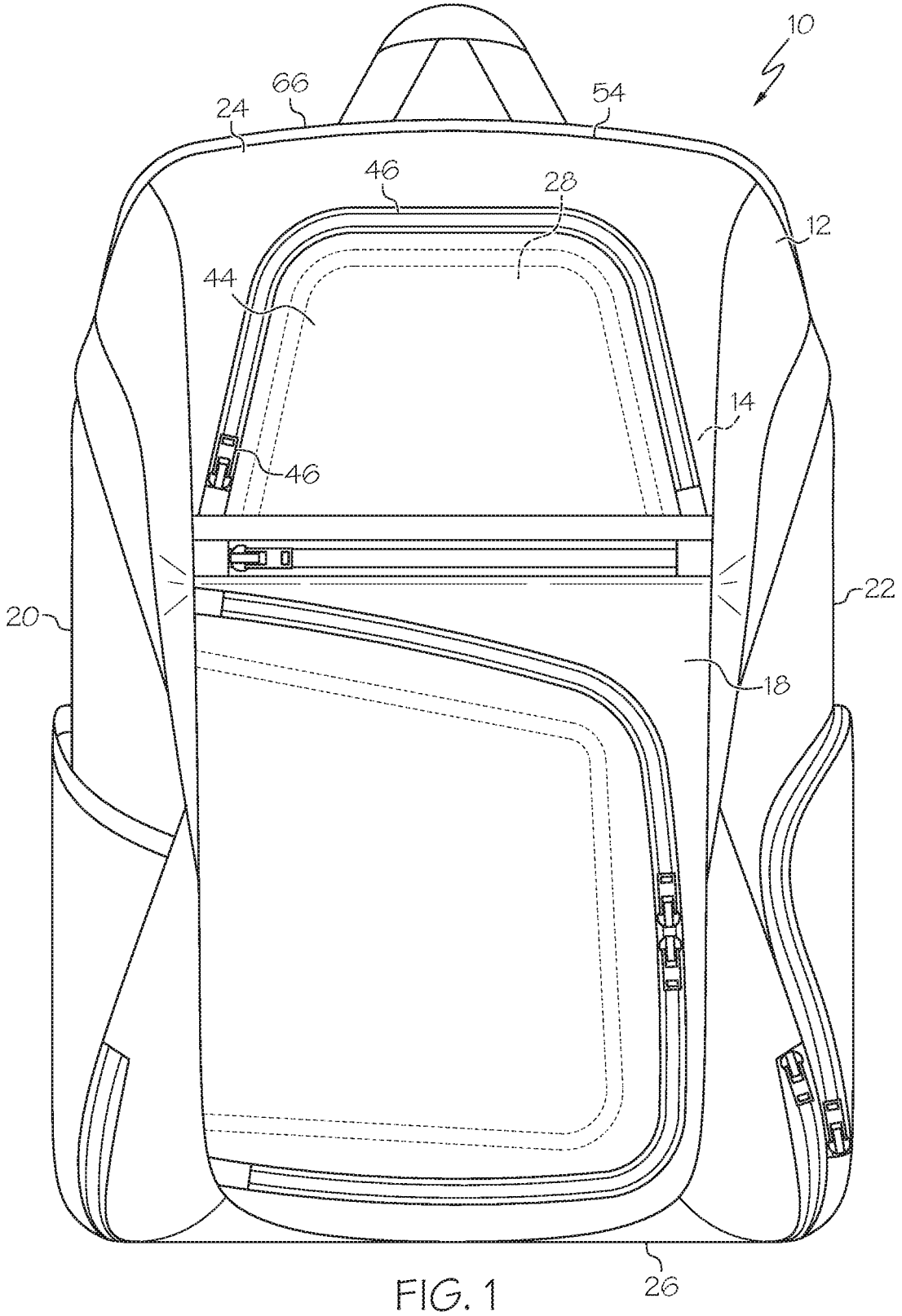
FIG. 1 is a front view of one embodiment of a backpack.
Figure 2:
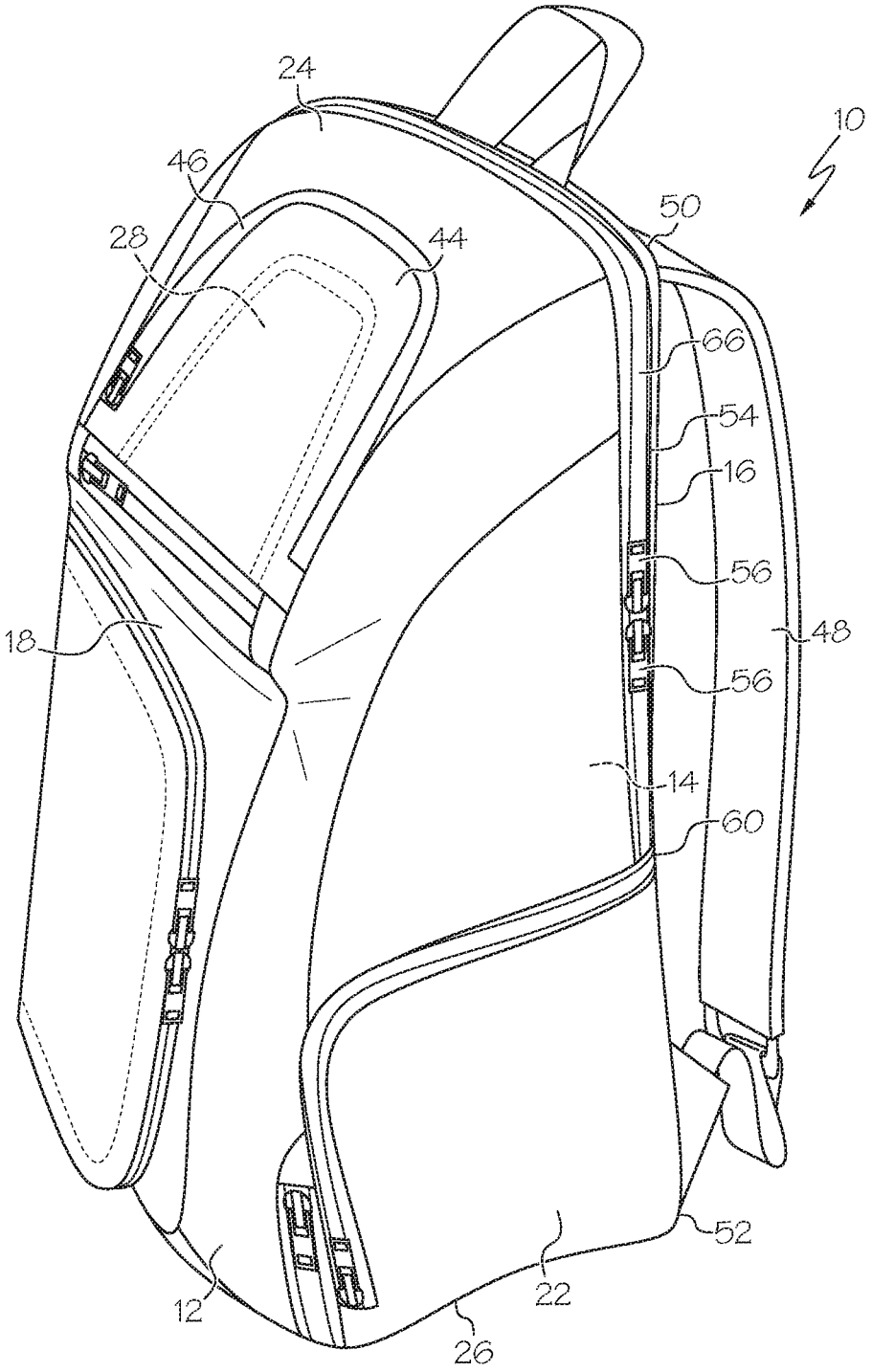
FIG. 2 is a front-side perspective view of the backpack of FIG. 1.
Figure 3:
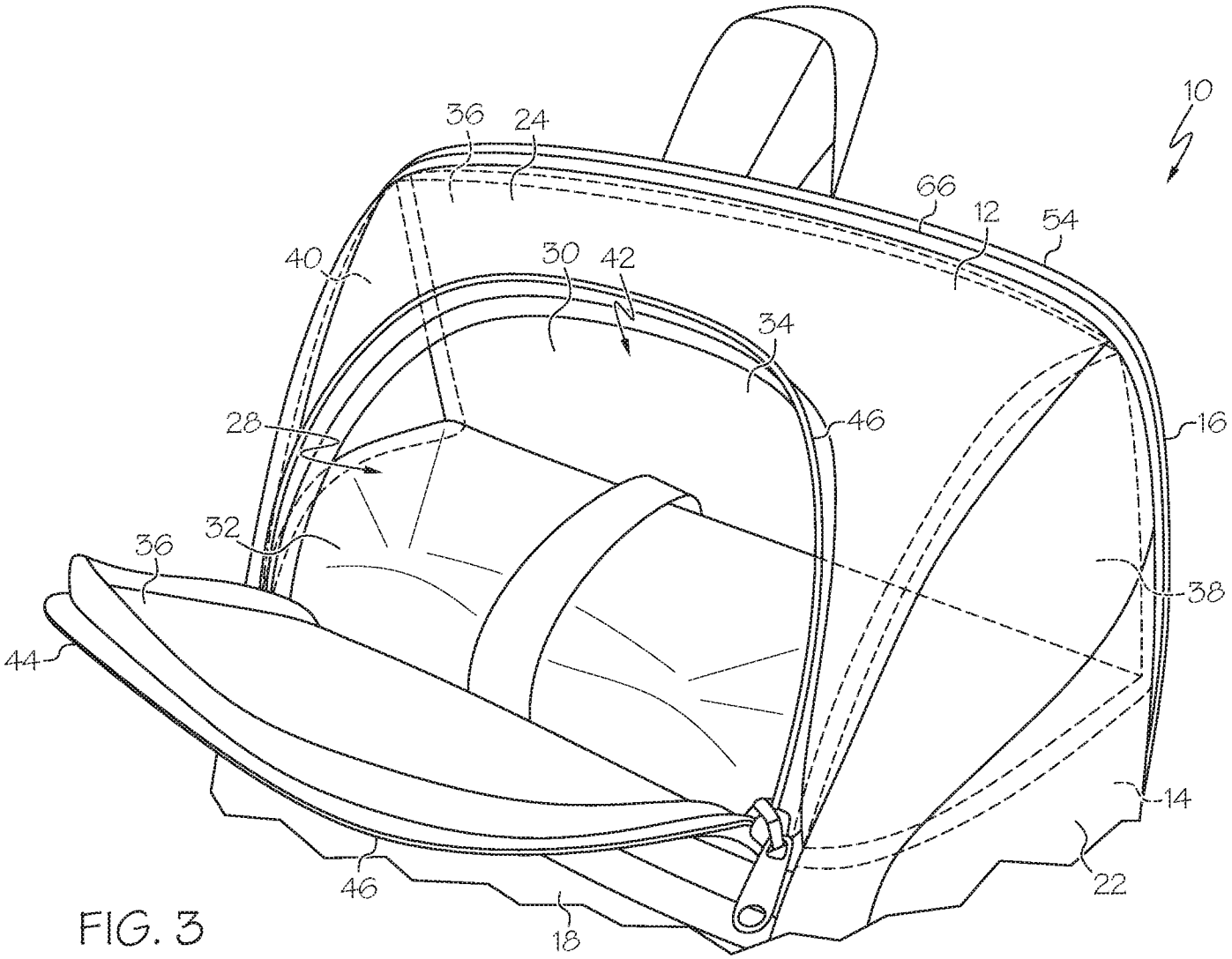
FIG. 3 is a detail view of an upper part of the backpack of FIG. 2, with a flap opened to provide access to the storage component.

With reference to FIG. 3, the backpack 10/body 12/cavity 14 can include a storage component 28 positioned therein. The storage component 28 can in one case be positioned entirely inside the cavity 14 and include or be defined by a storage component barrier or wall 30. In the illustrated embodiment the storage component wall 30 has or defines a bottom 32, back 34, front 36 and opposed sides 38, 40 of the storage component 28. The opposed sides 38, 40 can each be generally triangular such that the storage component 28/storage component wall 30 is generally shaped as a triangular prism in one case to fit closely against the angled/curved upper surface 24 and closely against the back surface 16 and/or front surface 18. The storage component 28 can thus be generally closed and entirely positioned in the body 12/cavity 14, and define a storage component cavity 42 therein that is positioned in, but generally separate from, the inner cavity 14.

In one case the storage component 28 is spaced away from, and not directly coupled to, the back surface 16 such that the back surface 16 is movable away from the storage component 28, as shown in FIGS. 6 and 7. In one case at least part of the front 36 of the storage component 28 includes a flap 44 formed therein, and also formed in or coupled to a corresponding flap of the body 12. As shown in FIG. 3, a releasable fastener 46 can extend around the flap 44 and is openable to provide access to the storage component 28. Thus the storage component 28 may be accessible, and only and exclusively accessible in some cases, via the front surface 18 and/or upper surface 24, or the front side of the body 12 by use of the flap 44. In one case the storage component 28 substantially fills an upper portion of the storage compartment 14, i.e. extends generally the entire width (in a left-to-right direction with respect to FIG. 3) and generally the entire depth (in front-to-back direction with respect to FIG. 3) of the inner compartment 14 in those areas (i.e. height dimensions) in which the storage component 28 is positioned.

The storage component 28/storage component wall 30 can be defined by a relatively thick, soft material which is thermally insulating, such as a polymer-covered foam. In this manner the storage component 28 can be used to store beverages, perishable food or other temperature-sensitive items, and thereby be used to store a lunch for student users, for example. In one case the storage component 28 can be positioned in the upper 50% of the backpack 10/body 12, and in one case is positioned as high as possible in an uppermost position of the backpack 10/body 12/cavity 14 such that, for example, the upper extent of the storage component 28 abuts against or is positioned immediately adjacent to the upper surface 24 of the body 12. Positioning the storage component 28 in this manner helps to ensure the contents of the storage component 28 are raised and protected from damage, such as due to crushing forces of other contents stored in the storage compartment 14 (which can be relatively heavy and/or bulky), or due to being trampled underfoot when placed on a ground surface, etc.

The body 12 can further include a pair of shoulder straps 48 attached thereto. In the illustrated embodiment, each shoulder strap 48 is secured to the body 12/back surface 16 at an upper attachment location 50 at or adjacent to upper surface 24. Each shoulder strap 48 can also be secured to the back surface 16 at or adjacent to the lower surface 26 (and/or adjacent to the side surfaces 20, 22) at a lower attachment location 52. The shoulder straps 48 could also or instead be coupled to the front surface 18, upper surface 24, lower surface 26 or side surfaces 20, 22. The shoulder straps 48 are configured to be worn around the shoulders of a wearer to position the back surface 16 adjacent to the back of a wearer. Alternatively, if desired, rather than using two shoulder straps 48, a single shoulder strap can be utilized to provide a backpack 10 in a configuration known as a "sling." Each shoulder strap 48 can include cushioning or padding material (such as foam) thereon, and be adjustable in its effective length, to allow the backpack 10 to be carried on the back of a wearer in a well-known manner.

The backpack 10 can include a releasable fastener 54 extending around the body 12 and/or part of the back panel 12 such that when the releasable fastener 54 is opened, at least part of the back panel 16 is separated from the remainder of the body 12 and is movable away from the remainder of the body 12 to provide access to the inner cavity 14. In contrast, when the releasable fastener 54 is closed, the back panel 16 is secured to the body 12 and access to the inner cavity 14 is blocked. The releasable fastener 54 can take any of a wide variety of forms, including a zipper, a slide fastener, hook-and-loop fastening material (i.e. VELCRO® fastening material), snaps, magnets and the like. In the illustrated embodiment the releasable fastener 54 takes the form of one or more zippers that can be fastened or released via one or more zipper pulls 56. It should be noted the releasable fastener 46 for the storage component 28 can also take the form of the releasable fastener 54 described above.

In the embodiment of FIGS. 1-7, the releasable fastener 54 is positioned at, and extends along, the junction between the back surface 16, on the one hand, and the side surfaces 20, 22 and the upper surface 24, on the other hand. The releasable fastener 54 can include or define a pair of spaced apart end points 58, 60 (FIGS. 4 and 5) which are, in the illustrated embodiment, positioned on opposite sides of the back surface 16, in one case at or adjacent to where the back surface 16 intersects the associated side panel 20, 22.

In this case, then, the releasable fastener 54 extends around the outer perimeter of the back surface 16, along the top of the back surface 16/upper surface 24 and along parts of both side surfaces 20, 22 in a generally inverted "U" shape. However the releasable fastener 54 can have a variety of other shapes and configurations. In addition, rather than be positioned strictly along the junction of the back surface 16 and side surface 20/22 and upper surface 24, all or part of the fastener 54 can be positioned on the back surface 16 and/or side surfaces 20,22 and/or upper surface 24. In one embodiment, however, the fastener 54 is entirely spaced apart from, and no portion of the fastener 54 is located on, the front surface 18. When the fastener 54 is fully opened/released, the backpack 10 includes and/or the fastener 54 defines a flap 62 formed in and flush with the back surface 16 which is pivotable away from the rest of the body 12 to an open position, as shown in FIG. 6.

In the embodiment of FIGS. 1-7 and best shown in FIGS. 4 and 5, the body 12/back surface 16 includes a hinge or hinge line 64 formed therein about which the body 12/back surface 16/flap 62 is predetermined or predisposed to bend. For example, in one case, the hinge line 64 is a line or area of weakness such that the body 12/back surface 16/flap 62 is weaker and/or thinner along the hinge line 64 as compared to other areas of the body 12/back surface 16/flap 62, such as areas positioned adjacent to (but spaced apart from) the hinge line 64. The hinge line 64 can be made of the same material as surrounding areas of the back surface 16, or at least the same outer-most material, but all or certain material (such as inner stiffeners or the like) can be thinned, weakened creased, hinged, or removed. The hinge line 64 can be generally internally positioned on the back surface 16 such that the hinge line 64 does not extend along an outer perimeter of the back surface 16.

The hinge 64 can be positioned between the upper attachment location 50 and lower attachment location 52 of the shoulder strap(s) 48, with respect to a height of the backpack 10 to ensure the hinge 64 is somewhat centrally located to provide desired access to the inner cavity 14, and to enable the shoulder straps 48 to provide desired weight-bearing characteristics. In addition, the hinge 64 can be positioned below the storage component 28 in a height direction (e.g. in a direction parallel to the back surface 16 and generally parallel to the straps 48). By positioning the hinge 64 below the storage component 28, the hinge 64 enables the flap 62 to open and provide access to the inner cavity 14 without the storage component 28 blocking such access (see FIG. 6). In particular, in one embodiment the hinge 64 is positioned below a lower-most surface of the storage component 28 by at least about 5% in one case, or at least about 10% in another case, or at least about 25% in yet another case, of a height of the backpack 10. Further alternatively, the hinge 64 can be positioned below a lower-most surface of the storage component 28 by no more than about 30% in one case, or no more than about 50% in another case, of a height of the backpack 10, to ensure sufficient access and storage capacity is provided. For example, if the hinge 64 were to be positioned too low, any contents of the inner cavity 14 may be able to bend/move the flap 62 above the hinge 64, and such contents would not be securely held in the inner cavity 14, thus effectively reducing the storage capacity of the inner cavity 14.

In the illustrated embodiment, the hinge line 64 is positioned on the back surface 16 and the fastener 54 extends below the hinge line 64 such that the end points 58, 60 of the fastener 54 are positioned below the hinge line 64. Thus the fastener 54 includes single, connected or continuous portion 66 positioned above the hinge line 64 and includes two spaced apart lower portions 68 each positioned below the hinge line 64. Extending the fastener 54 down past the hinge line 64 in this manner provides ease of operating the hinge 64/flap 62. In particular moving a fastener 54 to its full extent (i.e. positioning the zipper pull 56 adjacent the end points 58 and/or 60) can be somewhat difficult as materials tend to "pinch" near the end points 58, 60, and zippers or other fasteners can become separated or frayed at their end points 58, 60. Thus, by positioning the hinge 64 above the end points 58, 60, the fastener 54 need not open all the way to its end points 58, 60 in order to enable the hinge line 64/flap 62 to operate in the intended manner.

As best shown in FIGS. 6 and 7, the backpack 10 may include a pocket flap 70 positioned on an inner surface of the back surface 16, defining a back pocket 72 therewith. In the illustrated embodiment the pocket flap 70 has a width (extending generally in the lower left-to-upper right direction of FIGS. 6 and 7) about equal to a width of the back surface 16, and has a height (extending generally in the vertical direction) less than the back surface 16. In particular the pocket flap 70 may extend from a bottom-most edge of the back surface 16 to a position along its height as shown. The back pocket 72 may be sized to closely receive a standard-sized laptop therein.

The back pocket 72 can have a horizontally-oriented mouth 74 extending between the side surfaces 20, 22 that is positioned below a lower-most surface of the storage component 28. In this manner the storage component 28 does not block access to the back pocket 72, and the hinge 64 enables full access to the back pocket 72. In one case the mouth 74 is generally aligned with the hinge 64; i.e. in one case positioned within about 10% of a height of the backpack 10, in either vertical direction, of the hinge 64. General alignment of the mouth 74 and hinge 64 can ensure that easy access to the mouth 74 is provided.

In this manner, the flap 62/hinge 64 of the backpack 10 provide a relatively wide mouth such that improved access to the inner cavity 14 is provided, enabling access past or below the storage component 28 when opened, as shown in FIG. 6, and also provides access to the back pocket 72. In addition, the configuration of the fastener 54 ensures that the flap 62 can be easily operated.

Having described the invention in detail and by reference to the various embodiments, it should be understood that modifications and variations thereof are possible without departing from the scope of the claims of the present application.

What is claimed is:

1. A backpack comprising: a body including a front panel and a back panel, the back panel spaced from the front panel and defining an inner cavity therebetween; a storage component positioned within a portion of the inner cavity, the storage component having a back wall positioned immediately adjacent the back panel of the body; at least one shoulder strap coupled to the body; and a first releasable fastener movable between an open position and a closed position, the open position permitting access to the inner cavity of the body and the closed position inhibiting access thereto; a second releasable fastener movable to permit access to the storage component from the front panel of the body via a flap; wherein the back panel of the body includes an upper portion, a lower portion, and a hinge positioned therebetween, the hinge being disposed below the storage component when the body is positioned adjacent a user's back; and wherein the upper portion of the back panel is configured to pivot about the hinge when the first releasable fastener is in the open position to permit access to the inner cavity between the back wall of the storage component and the back panel of the body.

2. The backpack of claim 1, wherein the hinge is positioned below the storage component by at least about 10% of a height of the back panel.

3. The backpack of claim 1, wherein the storage component is at least partially formed of a thermally insulated material.

4. The backpack of claim 3, wherein the thermally insulated material is a polymer covered foam.

5. The backpack of claim 1, wherein the hinge includes a line of weakness such that the back panel is thinner along the hinge compared to the adjacent upper and lower portions.

6. The backpack of claim 1, wherein the back wall of the storage component is substantially parallel the back panel of the body when the first releasable fastener is in the closed position.

7. The backpack of claim 1, wherein the body further includes a pair of side panels extending between the back panel and the front panel, an upper panel extending between the back panel and the front panel along the side panels, and a lower panel extending between the back panel and the front panel along the side panels.

8. The backpack of claim 7, wherein the first releasable fastener extends at least partially along a junction between the back panel, the upper panel, and the side panels.

9. The backpack of claim 1, wherein the back panel is a generally flat, planar surface, and wherein the hinge extends across an entirety of a width thereof.

10. The backpack of claim 1, wherein the first releasable fastener includes one or a combination of a zipper, a slide fastener, a hook-and-loop fastener, at least one snap, and at least one magnet.

11. The backpack of claim 1, wherein the hinge extends at least partially along an inner surface of the back panel.

12. The backpack of claim 1, wherein the first releasable fastener includes a first endpoint and a second endpoint, and wherein the first and second endpoints extend below the hinge in a vertical direction such that the first releasable fastener includes a continuous portion positioned above the hinge and two, spaced lower portions extending below the hinge.

13. A method comprising: providing a backpack, the backpack including: a body including a front panel and a back panel, the back panel spaced from the front panel and defining an inner cavity therebetween; a storage component positioned within a portion of the inner cavity, the storage component having a back wall positioned immediately adjacent the back panel of the body; at least one shoulder strap coupled to the body; and a first releasable fastener movable between an open position and a closed position, the open position permitting access to the inner cavity of the body and the closed position inhibiting access thereto; a second releasable fastener movable to permit access to the storage component from the front panel of the body via a flap; wherein the back panel of the body includes an upper portion, a lower portion, and a hinge positioned therebetween, the hinge being disposed below the storage component when the body is positioned adjacent a user's back; and wherein the upper portion of the back panel is configured to pivot about the hinge when the first releasable fastener is in the open position to permit access to the inner cavity between the back wall of the storage component and the back panel of the body; moving the first releasable fastener between the closed position and the open position; and pivoting the upper portion of the back panel about the hinge to permit access to the inner cavity between the back wall and the back panel.

14. The method of claim 13, further comprising: accessing the storage component via the flap positioned on the front panel of the body.

15. The method of claim 13, wherein the storage component is at least partially formed of a thermally insulated material.

16. The method of claim 15, wherein the thermally insulated material is a polymer covered foam.

17. The method of claim 13, wherein the hinge includes a line of weakness such that the back panel is thinner along the hinge compared to adjacent portions of the back panel.

* * * * *